US005278553A

United States Patent [19]

Cornett et al.

[11] Patent Number: 5,278,553

[45] Date of Patent: Jan. 11, 1994

[54] APPARATUS FOR WARNING OF APPROACHING EMERGENCY VEHICLE AND METHOD OF WARNING MOTOR VEHICLE OPERATORS OF APPROACHING EMERGENCY VEHICLES

[75] Inventors: Robert H. Cornett, 11743 Hartsook St., North Hollywood, Calif. 91607; Jeffrey I. Berlin, Northridge, Calif.

[73] Assignee: Robert H. Cornett, North Hollywood, Calif.

[21] Appl. No.: 32,410

[22] Filed: Mar. 15, 1993

Related U.S. Application Data

[63] Continuation of Ser. No. 771,227, Oct. 4, 1991, abandoned.

[51] Int. Cl.[5] ..... G08G 1/00

[52] U.S. Cl. ..... 340/902; 340/903; 340/904; 340/906; 367/199

[58] Field of Search ..... 340/902, 903, 904, 906; 367/197, 198, 199

[56] References Cited

U.S. PATENT DOCUMENTS

| | | | |
|---|---|---|---|
| 3,568,144 | 3/1971 | Streb | 340/901 |
| 3,859,623 | 1/1975 | Koehler | 340/34 |
| 4,158,190 | 6/1979 | Stefanov | 340/34 |
| 4,238,778 | 12/1980 | Ohsumi | 340/33 |
| 4,380,004 | 4/1983 | Coats et al. | 340/902 |
| 4,587,522 | 5/1986 | Warren | 340/902 |
| 4,625,206 | 11/1986 | Jensen | 340/902 |
| 4,747,064 | 5/1988 | Johnston | 364/569 |
| 4,785,474 | 11/1988 | Bernstein | 381/56 |
| 4,794,394 | 12/1988 | Halstead | 340/902 |
| 4,864,297 | 9/1989 | Shaw et al. | 340/925 |
| 4,956,866 | 9/1990 | Bernstein et al. | 340/907 |
| 6,806,931 | 2/1989 | Nelson | 340/906 |

FOREIGN PATENT DOCUMENTS 2931977 2/1981 Fed. Rep. of Germany .

*Primary Examiner*—John K. Peng
*Assistant Examiner*—Nina Tong
*Attorney, Agent, or Firm*—Edward J. DaRin

[57] ABSTRACT

A method and apparatus for warning a motor vehicle operator of an approaching emergency motor vehicle having a sounding siren. The method comprehends selecting two frequencies A'-B' that fall within the siren frequency range and providing a microphone for detecting the sound signals including the siren signals and filtering out the electrical siren signals by a band pass filter. The selected A' and B' frequency signals are individually detected to provide output indications thereof representative of an A'-B' frequency transition. The output indications are processed for determining the preselected number of frequency transitions and producing a warning signal representative of the approaching emergency vehicle. The warning signal is utilized to give the motor vehicle operator an audible alarm and/or a visible alarm and deenergizing the motor vehicle's sound system.

29 Claims, 5 Drawing Sheets

APPARATUS FOR WARNING OF APPROACHING EMERGENCY VEHICLE AND METHOD OF WARNING MOTOR VEHICLE OPERATORS OF APPROACHING EMERGENCY VEHICLES

This application is a continuation of application Ser. No. 771,227, filed Oct. 4, 1991, now abandoned.

FIELD OF THE INVENTION

This invention generally relates to a method and apparatus for warning motor vehicle operators of an approaching emergency motor vehicle and more particularly electronic methods and apparatus for detecting the siren sounds emitted by an emergency vehicle approaching from a distance to warn a motor vehicle operator of the approaching emergency vehicle in sufficient time to permit corrective action.

BACKGROUND OF INVENTION

Sensor system incorporated into a motor vehicle for detecting the presence of an emergency vehicle's sounding siren are known in the art. The prior attempts to provide warning signals as known in the prior art have taken two forms of methods and apparatus. In one form of warning system both the emergency vehicle and non-emergency vehicle are equipped with a special transmitter and receiver, respectively, to activate an alarm system. Such systems include apparatus for deactivating the motor vehicle radio's speakers in response to the reception of a signal from the emergency vehicle transmitter. Prior art of this type of sensing system are typified by U.S. Pat. Nos. 4,794,394; 4,238,778 and German patent 29 31 977.

The second type of sensor systems incorporate the sensing system in a motor vehicle detecting the siren sounds emitted by an approaching emergency vehicle. These prior art systems include visual and/or audible alarms that are activated when the emergency vehicle having its siren operative reaches a predetermined proximity to the motor vehicle in which the siren sensor is mounted. Patents of this type are U.S. Pat. Nos. 4,785,474; 4,587,522; 4,158,190 and 3,859,623.

The problem of a motor vehicle operator hearing an approaching emergency vehicle's siren still persists despite the aforementioned attempts to solve the problem and to our knowledge no known sensing systems are presently commercially available. The problem, however, still persists since the environmental noises continue to increase and motor vehicles, passenger vehicles and trucks or the like, are constructed so that the closed windows tend to seal off the environmental noises but yet the motor vehicles contain other devices that impair a motor vehicle operator's hearing such as radios with a multiplicity of speakers, tape players and/or compact disc players, air conditioning and/or heating equipment. Obviously, the problem is aggravated when the windows of the motor vehicle are open and the aforementioned accessories are in use.

The inability of a motor vehicle operator to hear an approaching emergency vehicle's sirens has resulted in accidents, particularly at intersections, that result in Collisions with the emergency vehicles and with the consequential damages to the vehicles, property, personal injuries and even death as well as the inability of the emergency vehicle to arrive at the place of the emergency. The problems of prior art known systems appears to be in the complexity of the apparatus and therefore rendering the apparatus expensive to implement on a commercial basis. This includes the fact that the detection techniques of some of these prior art devices are narrowly defined for certain types of sirens and/or signals to be sensed. To a large extent, the known prior art devices are designed with the microphones sensing the siren sounds on the outside of the motor vehicle which subjects the microphone to all environmental noises found in present day traffic conditions and wind noises that may mask the siren sounds or impair operation of the sensing systems for practical uses. There is then, a present need for a method and apparatus for detecting the siren sounds of an emergency vehicle for warning motor vehicle operators of the approaching emergency vehicles in sufficient time for the motorist to take the necessary action to avoid any possible collision with the emergency vehicle and a method and apparatus that is relatively inexpensive and dependable in operation for this purpose by avoiding the problems of prior art systems.

SUMMARY OF INVENTION

The present invention provides an improved, dependable and a relatively inexpensive method and apparatus for warning a motor vehicle operator of an approaching emergency vehicle having an operative siren to enable the motor vehicle operator to be alerted in sufficient time to avoid the emergency vehicle and the possibility of collisions. The method and apparatus of the present invention includes selecting a narrow band of frequencies for processing and simple techniques for assuring that false alarm signals are avoided. The apparatus is constructed of inexpensive, reliable, integrated circuit components that are commercially available and yet designed to eliminate false alarms that may be triggered by environmental noises or build up with time to cause false alarms. To this end the audio sensing microphone is mountable on the motor vehicle with a protective environmental shield to avoid prior art problems of mounting on the outside of the motor vehicle.

From a broad method standpoint, the present invention comprehends a method of warning a motor vehicle driver or operator of an approaching, distant emergency motor vehicle having a sounding siren by a method of electronic sensing siren sounds or the like by selecting two audio frequencies that fall within the frequency range of a siren to be electronically detected and processed, preferably in the mid-frequency range and providing a microphone for the motor vehicle that converts the audio signals including the siren sound signals to corresponding electrical signals, the received signals are filtered for attenuating the unwanted signals and providing the signals within the selected frequency range, the selected frequency signals are processed for determining the number of frequency transitions of the selected siren frequencies to assure against false alarms and providing an alarm signal once the correct number of preselected frequency transitions have been determined.

From an apparatus standpoint, the invention is constucted and defined to be responsive to selected A'-B' frequency signals within the siren frequency band A-B by the provision of means for detecting the audio siren signals and associated audio signals for conversion to corresponding electrical signals. The apparatus including amplifying means for the microphone electrical signals and band pass filtering means for attentuating the unwanted audio signals and provide output signals within the A–B frequency range. Circuit means are provided within the apparatus for detecting the A′ and B′ frequency signals independently and providing output indications upon the detection of each frequency signal, the apparatus includes means for processing the A′–B′ frequency signals representative of the frequency transitions for detemining a preselected number of frequency transitions that occur within a preselected time period for reliability and correctly providing an alarm signal to the vehicle operator.

Along with the warning signal the vehicle's sound systems may be rendered inoperative to further aid the vehicle's operator to hear the approaching siren and to take the necessary corrective action.

The apparatus may include an automatic reset circuit for resetting the alarm signal and a delay period between successive alarm signals.

BRIEF DESCRIPTION OF THE DRAWINGS

These and other features of the present invention may be fully appreciated when considered in light of the following specification and drawings, in which.

DETAILED DESCRIPTION OF THE PREFERRED EMBODIMENT

Figure 2:
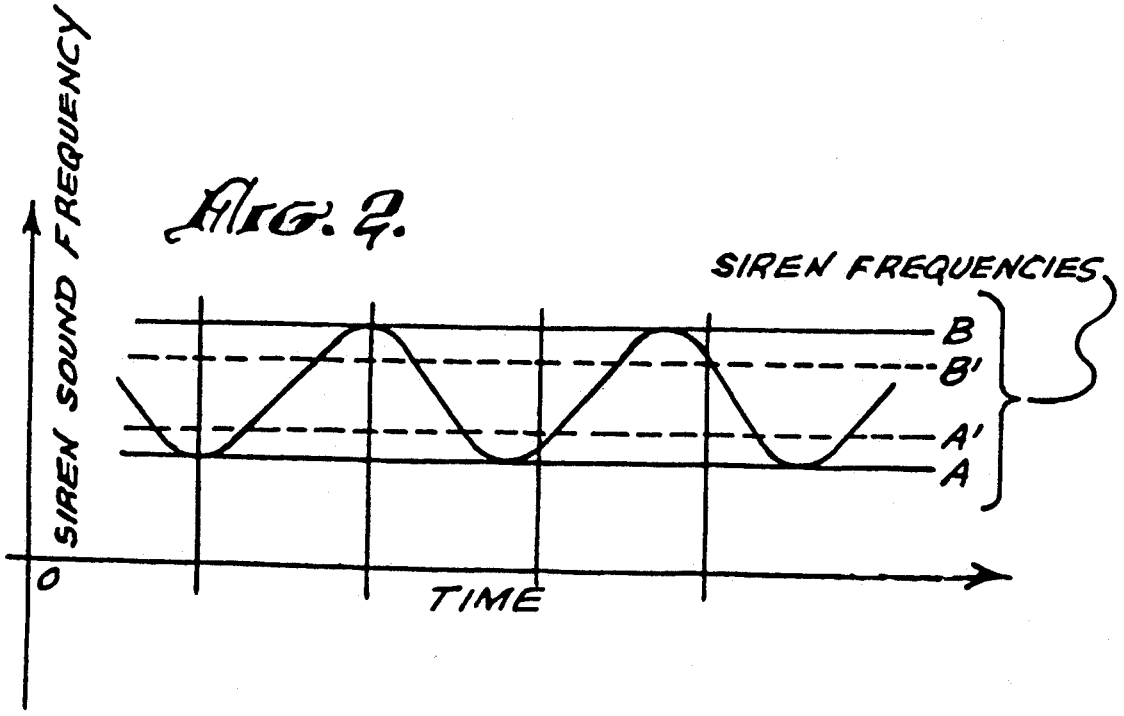
FIG. 2 is a graphical illustration of siren sound frequencies A–B with the selected frequencies A′–B′ illustrated in dotted lines.

At the outset It should be recognized that the siren sounds emitted by most, current American sirens fall within the range of 600–1600 cycles per second. This frequency range is represented in FIG. 2 by the A–B frequency range, i.e. the "low A" frequency and the "high-B" frequency. The repetition rate of these siren frequencies vary, as is well known, depending on whether the siren is a "wail" or a "yelp" type of siren. The present invention eliminates the need to take into consideration the repetition rate of the siren frequencies by advantageously selecting frequencies to be processed by the sensor system SS within the approximate mid-range of the siren frequencies, identified in FIG. 2 as the A′ and B′ frequencies. These frequencies can be considered for the present invention as the A′ frequency being 1200 cycles per second and the B′ frequency as 1300 cycles per second. The selection of these frequencies is preferable to sensing the outer limits of the siren frequencies as they are more reliably representative of the siren frequencies to be sensed. Obviously, the same selection may be made for sirens operating within a different frequency band.

Figure 1:
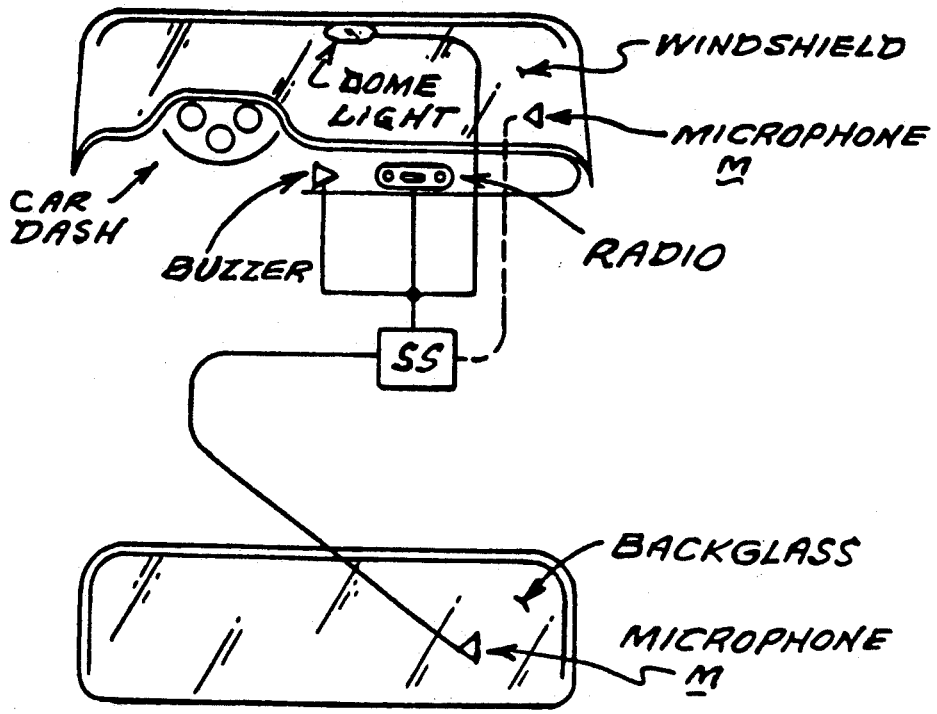
FIG. 1 is a diagrammatic representation of a passenger motor vehicle's interior illustrating the arrangement of the siren sensing apparatus therein in accordance with the present invention.

Now referring to FIG. 1, the general arrangement of the siren sensing system SS as applied to a present day passenger motor vehicle is illustrated from the standpoint of a motor vehicle. It should be appreciated that the siren sensing system could also be mounted on trucks, vans or utility vehicles and motorcycles. The microphone M is suitably mounted on the motor vehicle and is preferrably mounted with an environmental shield to protect it from dirt, dust, rain, snow or the like. The microphone M may be mounted adjacent the front or rear windshield. The siren sensor SS is illustrated as housing the associated electronic sensing system in a compact package that may be mounted in the trunk of the vehicle or under the dashboard for the vehicle. The illustrated motor vehicle includes a radio and may also include magnetic tape player or Compact Disc player that are all electrically powered from the motor vehicle battery, 12 volts.

Figure 3:
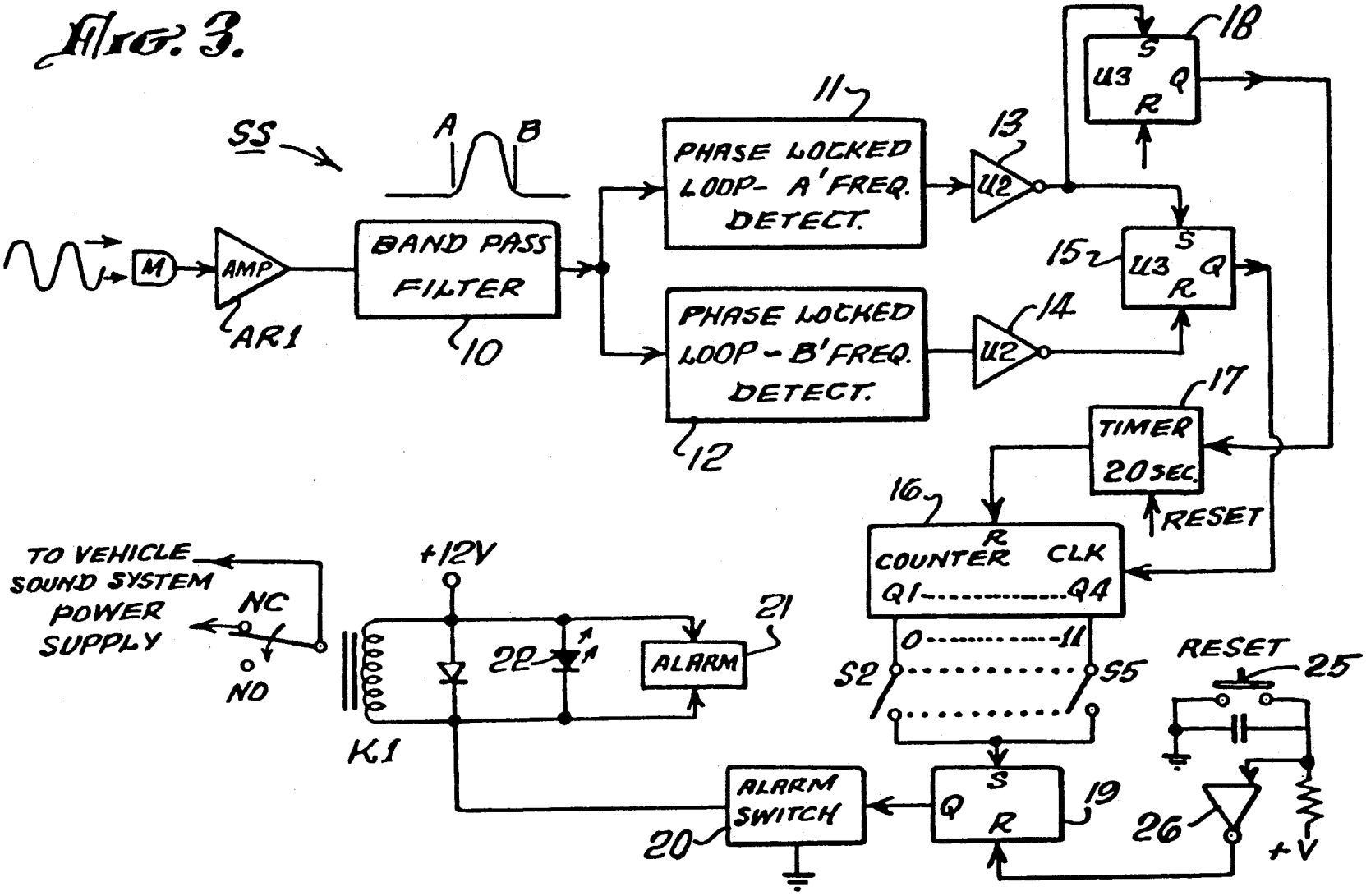
FIG. 3 is a block-circuit diagram of the siren sensing system embodying the present invention.

Now referring to FIG. 3, the general organization of the siren sensing electronic system will be examined. The microphone M of conventional, commercial structures is sufficiently sensitive to detect the distant siren sounds, namely from a distance of 800–1000 feet to permit the driver to react. The electrical signals representative of all the audio signals including the loud siren signals are coupled to an amplifier AR1. The amplified version of the detected audio signals are coupled to a band pass filter 10. The band pass filter 10 is constructed and defined to transmit the band of frequencies denoted as the A–B frequency band and to attenuate the remaining audio signals. The A–B band of frequencies is coupled to a pair of phase locked loops 11 and 12 for detecting one of the selected frequencies A′ and B′ and provide an output indication therefrom upon the detection of the selected frequency A′ and B′. The phase locked loop 11 is defined to detect the A′ frequency, while the phase locked loop 12 is defined to be responsive to the frequency B′. The output signals from the phase locked loop circuits 11 and 12 are coupled to individual inverter circuits 13 and 14 respectively. In terms of logic level states the output indications from the phase locked loops 11 and 12 are considered to be a high voltage state during the time intervals that the A′ and B′ frequencies are not detected and are pulled to low state upon the detection of the A′ and B′ frequencies. These signals are inverted in state by the respective inverters 13 and 14 so that a high output state resides at the output of the inverters 13 and 14 during the time intervals that the A′ and B′ frequencies have been detected. An R-S latching circuit 15 is coupled to receive the output signals from the inverters 13 and 14. The inverter 13 output signals are coupled directly to the set (S) terminal of the latch 15, while the signals from the inverter 14 are coupled to the reset (R) terminal of the latch 15, the output terminal of the latch 15 is identified as the Q output. Upon the detection of the A′ frequency, the high level+ input signal functions to change the state of the latch 15 so that the Q output changes to a high state and may be considered a binary 1 state. This signal (binary one) is coupled to the clock (clk) input terminal of a binary coded decimal counter 16 to be counted. The frequency transitions of the A′ and B′ frequency are processed by counting the frequency excursions as they are detected by the phase locked loops 11 and 12. After the B′ frequency has been detected, the high state signal coupled to the reset (R) terminal of the latch 15 resets the latch and the Q output assumes a low output state indicative of a A′–B′ frequency transition.

In accordance with the present invention to prevent spurious A'-B'frequency transitions to be counted, the time between the detection of the A' frequency and the next A' frequency is timed by the timing circuit 17. The timer circuit 17 has a preset time interval and is actuated from the Q output terminal of the latch 18. The latch 18 has its set terminal S coupled to receive the output signals from the inverter 13 so that the Q output will be set to a high level state to initiate the timer 17 with the detection of the A' frequency. If the timer 17 times out before the next A' signal is detected, a resetting state is coupled to the reset (R) terminal of the counter 16 to reset the counter and to prevent the spurious frequencies to be processed. If the A' frequency is detected within the timing period of timer 17, the A'-B'-A' transition is counted and the timer 17 is reset to commence another timing period upon the detection of the next frequency transitions from B' to A'. In this manner the A'-B' frequency transitions are counted and an individual decimal count is selected by the operation of the switches S2-S5 that are respectively coupled to the $Q_1$ . . . $Q_4$ output terminals of the counter 16. The selected output state of the counter 16 is coupled to the set (S) input terminal of a latch 19. The setting of the latch 19 causes its Q output terminal to assume a high state that energizes the alarm switch 20.

The alarm switch 20 is powered from the vehicle battery so that with the energization of the alarm switch 20, an audible alarm 21 is actuated and/or a warning light signal, such as the illustrated light emitting diode 22 is energized to give the motor vehicle operator the warning of the approaching emergency vehicle. At this same time a relay K1 maybe actuated so that the associated movable contacts that are arranged in series with the power supply leads to the vehicle's sound system is interrupted and thereby deenergize the components of the sound system, i,e, radio, tapes, etc.

A reset button 25 is provided for the sensor system SS. The reset button 25 is coupled to a power source V and is normally arranged in an open circuit relationship, as illustrated. An inverter circuit 26 has an input coupled to one terminal of the reset button 25 so that when it is operated, a signal is coupled to the inverter 26 and a corresponding signal appears at the reset (R) terminal of the latch 19. With the resetting of the latch 19, the alarm switch 20 is deenergized and the alarm signals are all deenergized.

Figure 4:
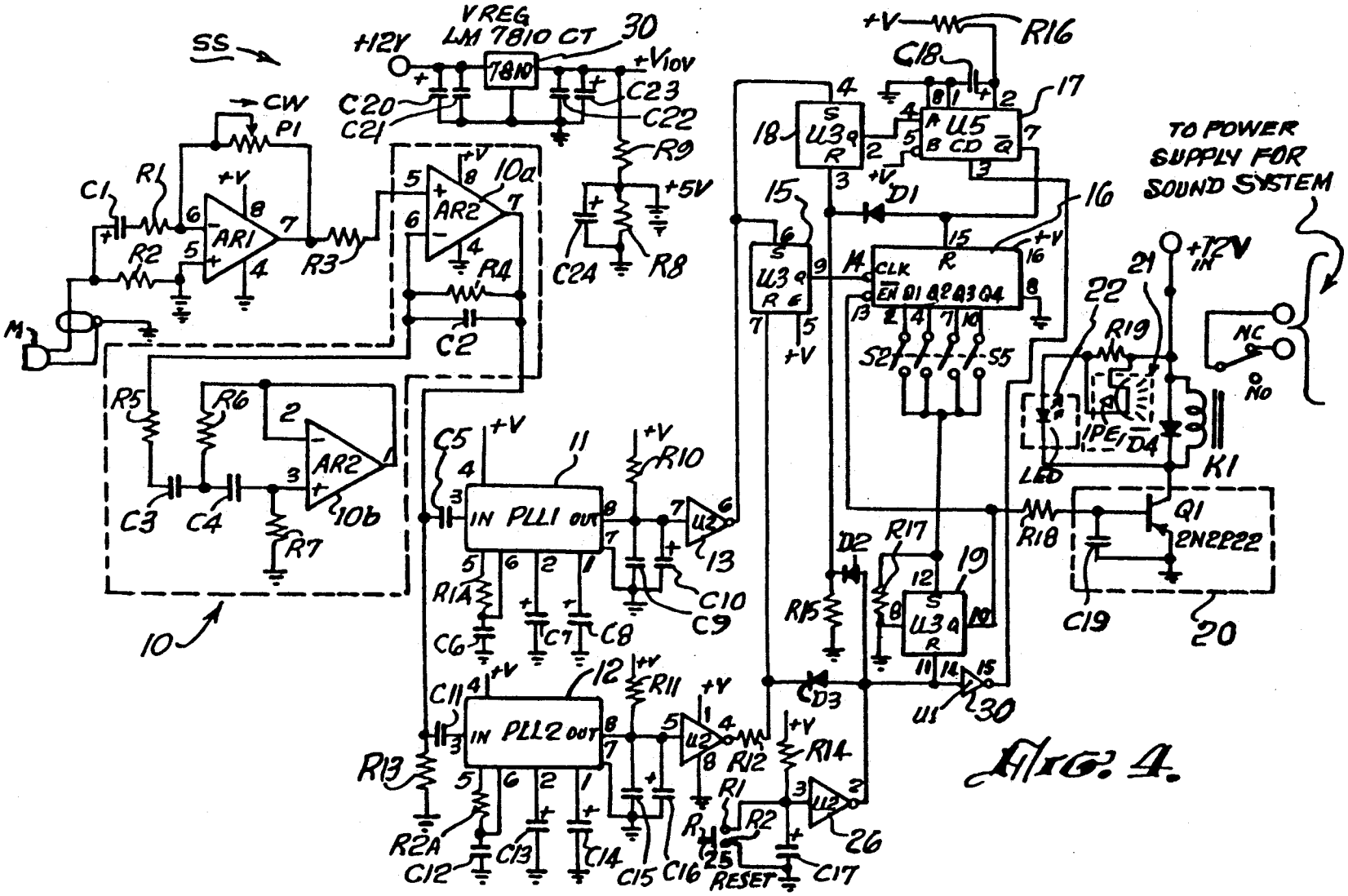
FIG. 4 is a schematic circuit diagram of the siren sensing system of FIG. 3.

Now referring to FIG. 4, the detailed, schematic circuit diagram will be examined with the above description in mind. The siren sensing circuit SS as illustrated is adapted for use in a motor vehicle and to be powered from the vehicle's power source, normally a 12 volt battery. The 12 volt output voltage is converted to a primary voltage of 10 volts and a 5 volt phantom ground voltage for powering the electronic components of the siren sensor SS. For this purpose a voltage regulator 30 of a commercially available construction is provided. One commercially available regulator that is suitable is the model LM 7810 CT available from the National Semiconductor Co. The regulator is provided with two input, parallel arranged capacitors C20 and C21 connected between the input terminal of the regulator 30 and ground. The output terminal for the regulator 30 is also provided with a pair of parallel arranged capacitor C22 and C23 that are connected to ground. This circuit organization provides a constant 10 volt output for the circuit elements of the sensor SS. The phantom ground voltage of 5 volts is provided by the voltage divider network comprising the series connected resistors R8 and R9. One terminal of the resistor R9 is connected directly to the output terminal of the regulator with its opposite terminal connected in common with one terminal of the resistor R8. The opposite terminal of the resistor R8 is connected to ground potential. A by pass capacitor C24 is coupled across the terminals of the resistor R8, as illustrated. The common junction between the resistors R8 and R9 is identified in the drawing by a double ground symbol or the phantom ground. The resistance values of the resistors R8 and R9 are the same so that the double ground symbol represents the 5 voltage terminal when so indicated in the drawings while the +V indicatation represents connection to the 10 volt output terminal of the regulator 30.

The microphone M when mounted to the motor vehicle monitors the sound which includes the environmental sounds and any siren sounds. The sound signals are converted into electrical signals at the output terminals of the microphone M. An amplifier AR1 is coupled to the microphone M output terminals to provide an amplified version of the electrical signals. For the purpose of the invention the amplifier AR1 is a high performance, low noise operational amplifier. Such an amplifier is available in the form of an integrated circuit (I.C.) package that has two amplifiers in a single package and is available from Signetics as the NE 5532 AN device. The integrated circuit is available in a FE or N package and the drawing illustrates the pin connections for such a package. The other half of the Signetics package is not used. The negative input terminal of the amplifier is pin 6 that is connected to one output terminal of the microphone M through the series combination of the capacitor C1 and resistor R1. The other terminal of the microphone M is coupled to ground, as illustrated. Pin 5 of amplifier AR1 is the positive input terminal for the amplifier. Pin 5 is connected directly to the 5 V, phantom ground. A resistor R2 is coupled to the positive output terminal of the microphone M in commom with one terminal of the capacitor C1 and the phantom ground as illustrated. Pin 8 of amplifier AR1 is connected to the +V terminal while pin 4 is connected directly to ground. The output terminal, pin 7, is connected to the input pin 6 through a variable resistor P1 for controlling the gain of the amplifier. The band pass filter 10 comprehends the pair of operational amplifiers AR2, **10*a* and 10*b*, and the associated circuit elements for defining a gyrator based band pass filter which attenuates out all unwanted signals outside the A and B frequency range and transmits the frequency signals within the band. The amplifier AR2, 10*a* and 10*b*, are defined in terms of the same type of Signetics I.C. package as an amplifier AR1, however, both amplifiers of the package are utilized. The amplifier 10*a* is coupled to receive the output signals from the amplifier AR1. Pin 5 of amplifier 10*a* is denoted the positive input terminal and is coupled directly to the output pin 7 of AR1 through a series resistor R3. Pin 8 of amplifier 10*a* is connected to +V while pin 4 is connected to ground potential. Pin 7 is the output terminal of amplifier 10*a*. Between the amplifiers 10*a* and 10*b*, circuit elements including R6, R7 and C4 are defined and proportioned to function as the inductor of the band pass filter. To this end, the resistor R4 and the capacitor C2 are connected in parallel circuit relationship between the input and the output terminals of amplifier 10*a*, namely pins 6 and 7 respectively. Pin 6, the negative input of amplifier 10*a* is connected to the positive input terminal of amplifier 10***b*, pin 3 through the series resistor R5 and a pair of capacitors C3 and C4. One terminal of capacitor C4 is connected in common with one terminal of capacitor C3 while the other terminal of capacitor C4 is connected to pin 3. A resistor R7 is connected to pin 3, of amplifier 10*b* and ground potential. The output pin 1 of amplifier 10*b* is connected directly to the negative input terminal, pin 2, of the amplifier. A resistor R6 is coupled to the common junction of the capacitor C3 and C4 and the input pin 2 of amplifier 10*b*. This configuration of a gyrator band pass filter is commonly employed in audio work.

The output signals (A–B band) are coupled from the band pass filter 10 by means of pin 7 of amplifier 10*a* to the input terminal of a pair of phase locked loop circuits 11 and 12. The phase locked loop components utilized for the invention is the Signetics product NE 567 in a FE, D, N integrated circuit package. This integrated circuit package comprises a tone and frequency decoder and a highly stable phase-locked loop with synchronous AM lock detection and power output circuitry. The primary function of the elements 11 and 12 is to drive a load whenever a sustained frequency within its detection band is present at the self-biased input. The band with center frequency, and output delay are independently determined by means of four external components. The internal, well known, circuit configuration of each phase looped circuit 11 and 12 comprises a phase detector, current controlled oscillator, quadrature phase detector and associated amplifiers (not shown). The circuit 11 is tuned to be responsive to the A′ frequency and provide an output indication representative of the detected A′ frequency. Similarly, the circuit 12 is tuned to be responsive to the B′ frequency. In terms of the pins for the circuit package, input pin 3 of circuit 11 is coupled to the output of band pass filter 10 by means of a capacitor C5. This pin 3 is the input to the internal phase detector of the circuit 11. Pins 5 and 6 are connected to the current controlled oscillator of the I.C. package, as illustrated, pin 5 is connected to ground potential through the series resistor R1A connected to pin 5 and capacitor C6, with the other terminal of the capacitor connected to ground potential. Pin 6 is connected to the common junction between resistor R1A and capacitor C6. The quadrature detector is internally connected to the input pin 3. Pin 4 is connected to +V potential while pins 1 and 2 are connected to ground potential through individual capacitors C7 and C8, as illustrated. The output terminal of the IC package is pin 8 at which a voltage signal appears upon detection of the A′ frequency signal. This output signal appears at pin 8, while pin 7 is connected directly to ground potential. Filter capacitors C9 and C10 are connected in a parallel circuit relationship between output pin 8 and ground. Pin 8 is also connected to +V potential through a series resistor R10. The oscillator circuit of the I.C. package is tuned to the A′ frequency for decoding the input signals from the band pass filter present at pin 3. The voltage level at pin 8 is normally at a high voltage level and when the A′ frequency is detected the voltage level of pin 8 is pulled to a low level state. The output capacitor C9 and C10 and resistor R8 are proportioned to filter out any spurious reponses of the circuit element 11. The output signal from the circuit element 11 is connected directly to the input circuit of an inverter circuit 13. Accordingly, the low output signal of the circuit 11 produced when the A′ frequency is detected causes the output of the inverter 14 to be set to a high voltage level state for processing the fact that the A′ frequency signal has been detected.

The phase locked loop circuit 12 is constructed identically to the circuit 11 except it is tuned to be responsive to the B′ frequency signal from the band pass filter 10; i.e. an identical Signetics I.C. package is utilized. The input pin 3 of the circuit 12 is coupled to the band pass filter 10 through the input capacitor C11. A resistor R13 is connected in common with the input terminals of capacitors C5 and C11 and ground potential. The remaining external components of the circuit 12 are connected to the same pins as for circuit 11 but bear different reference numerals but have the same values as for circuit 11 except resistor 2A for circuit 12 and resistor 1A for circuit 11. The output pin 8 for circuit 12 is coupled to the input circuit for the inverter circuit 14. The inverter circuits 13 and 14 may be CMOS, low current devices and may be two of the inverters in the IC package of Motorola MC 14049 UB. Pins 7 and 6 are the respective input and output pins for inverter circuit 13 while circuit 14 has input and output pins 5 and 4, respectively. Pin 1 of circuit 14 is connected to +V for the IC package while pin 8 is the ground connection for the package.

The output circuit for the inverter 13 is coupled to the set (S) input terminal for a R-S latch 15, pin 6. All the latches 15, 18 and 19 are secondarily identified as the latches U3 are a single I.C. package with one latch of the package unused. The U3 latches are MC 14043 B CMOS logic devices obtained from Motorola. The latch 15 has its reset (R) terminal at pin 7 and its output terminal Q at pin 9. Pin 5 is the enable input and is connected to +V level, 10 volts. A high output level signal from inverter 13, representative of an A′ frequency signal, causes the latch 15 to be "set" so that the Q output pin 9 is switched to a high voltage level (from its low voltage state as a result of power on reset). The Q output of the latch 15 is connected directly to the clock (CLK) input of a binary-coded decimal counter 16 so as to be responsive to each A′ frequency excursion for counting up the counter 16.

The detection of an A′ frequency signal simultaneously sets the R-S latch 18. For this purpose, the high output voltage level signal from the inverter 13 is coupled to the set (S) input terminal, pin 4, of the latch 18 resulting in switching of the Q output pin 2 to a high voltage level state. The reset (R) terminal is pin 3. The Q output level for latch 18 is coupled to actuate a timer 17. The timer 17 is defined as a monostable, multivibrator circuit (one-shot). An IC package that is suitable for the timer is the Motorola IC package MC 14528 BE that is characterized as a dual, retriggerable, resettable, monostable, multivibrator. Only one of the multivibrators is used of the IC package. The timer 17 is defined to control the time period so that the counter 16 is permitted to count only the A′ frequency transition of a siren. This time period is set for 20 seconds in accordance with the present invention. The "one shot" timing circuit 17 has its input terminals identified as the A–B terminals, pins 4 and 5 respectively. The A terminal is connected directly to the Q output of the latch 18. The B terminal is connected directly to the +V voltage. The output terminal $\overline{Q}$, pin 7, provides the output indications from the timer 17. The $\overline{Q}$ output is coupled directly to the reset (R) terminal for a counter 16. The CD terminal, at pin 3 is the reset terminal and will be discussed hereinafter. The remaining terminals, pins 1,2, and 8 for timer 17 are connected as illustrated. Pin 2 is connected by means of a resistor R16 to +V voltage level while pins 8 and 1 are connected directly to ground and capacitor C/B is coupled between pins 1 and 2. The time period of the timer 17 is variable. With the setting of latch 18, the timer 17 is fired at pin 4 which in turn sets its $\overline{Q}$ output to a low voltage level that is coupled to the reset (R) terminal of the counter 16 enabling it to count for a period determined by the setting for the timer 17, i.e. 20 seconds. The time set for the timer 17 is to guarantee against false alarms triggering the alarms by spurious A', B' frequency sources over long periods of time. If the timer 17, once triggered, times out (20 seconds elapses) before another A' frequency transition occurs, then the $\overline{Q}$ output returns to its normal high voltage state so as to reset the counter 16 to its initial state.

The binary coded-decimal counter 16 counts the pulses received from the latch 15 as its clock input, pin 14. A practical counter that may be utilized in the present invention is the Motorola IC package Mc 14017 B characterized as a decade/counter divider. The counter 16 is a five stage Johnson decade counter with built in code converter. Pin 13 is the clock enable input. The binary coded decimal outputs are the Q1, Q2, Q3 and Q4 outputs at the respective pins 2,4,7 and 10. These Q1–Q4 outputs represent counting up the counter 16 and respectively represent the decimal counts 1,2,3,and 4. The resetting input for resetting the counter 16 is at pin 15. Pin 8 is connected to ground while pin 16 is connected to +V. The output pins are connected, individually to manually set switches S2, S3, S4, and S5, for selecting the decimal count output (high output) from the counter 16. The sensitivity of the sensor SS can be controlled by increasing or decreasing the switch settings of switches S2–S5. The sensitivity decreasing with the increase of the number of A'–B' frequency excursions selected to be counted with a selection of a switch setting of the counter 16, a high state, "set" signal is coupled to the S input terminal, pin 12, for latch 19. The latch 19 is of the same construction as the other "U3" latches (15 and 18) and has its Q output, pin 10, set at a high voltage state. Pin 11 for the latch 19 is the reset (R) input while pin 8 is coupled to ground potential with a resistor R17 connected from pin 12 to pin 8.

The voltage level at the Q output terminal of the latch 19 controls the actuation of the alarm signals by controlling the normally de-energized alarm switch 20. A high voltage level at pin 10 of latch 19 will render the alarm switch 20 conductive to actuate any visual or audible alarms and deactivates the vehicle's sound systems such as the radio, tapes, etc. The alarm switch 20 is illustrated in FIG. 4 as a switching transistor Q1, type 2 N 2222, that is normally arranged in a non-conductive state. The base electrode of Q1 is coupled by means of a series resistor R18 to the output of latch 19. The emitter electrode of Q1 is connected to ground with a capacitor C19 connected between the base and emitter electrodes. The collector electrode of transistor Q1 is connected to the +12 vehicle battery voltage through a diode D4. The circuit arrangement is such that the de-energized transistor Q1 will maintain all alarms off and high Q signal from latch 19 will cause the transistor Q1 to conduct and render the alarm devices conductive. The devices illustrated are a light emitting diode LED1 and piezo element, audible alarm PE along with relay coil K1 coupled across the terminals of the diode D4. The piezo electric element PE is arranged with a resistor R19 connected across its terminals and to the positive side of the diode D4. The relay coil K1 may have a number of contacts and a normally closed contact is illustrated in series circuit relationship with the power circuit to the vehicle's sound system. The energization of relay coil K1 will cause the contacts to be switched to the open position to open the power lines thereby de-energize the sound system. The diode D4 shunts out the magnetic field of relay coil K1 when the magnetic field collapses.

A manual reset button R is illustrated in FIG. 4 in a normally open state with its pair of contacts. Contact R2 is connected directly to ground level. Contact R1 is connected through a resistor R14 to +V voltage level. A capacitor C17 is connected across the terminals R1 and R2. An inverter circuit 26 is connected at its pin 3 in common with contact R1 and the bottom side of resistor R14. The output pin 2 of the inverter 26 couples signals to cancel the alarm signals and all digital components enabling the siren sensor SS to initiate a new sequence as a result of the operation of the button R. The signals from inverter 26 are coupled to the digital devices 15, 16, 17, 18 through the diodes D1, D2, D3 and inverter 30. The signal from the inverter 26 is coupled directly to the reset (R) terminal for the latch 15 by means of the diode D3. Similarly, the latch 18 is reset by a signal from inverter 26 coupled through diode D2. The reset lead wire includes a series resistor R15 connected between pin 3 of latch 18 and ground level. Latch 19 is reset directly from inverter 26 as a result of being connected to its pin 11. An inverter 30 couples the inverted signal from inverter 26 to pin 3, the CD terminal of timer 17 to reset the timer 17.

With the above structure in mind the operation of the siren sensor SS will be further described. The environmental sounds and any siren sounds are monitored by the microphone M and converted to corresponding electrical signals. The electrical signals are amplified at amplifier AR1 to a preselected level and coupled to the band pass filter 10. The electrical output signals from the filter 10 are primarily the signals falling within the A–B frequency band and the remaining frequency signals are attentuated. These output signals are coupled to the input terminals of the phase locked loops 11 and 12. In the event an A' frequency is detected at loop circuit 11 then a low voltage level state will appear at pin 8. This low state is inverted to a high output state by inverter 13 and is simultaneously coupled to the set (S) terminals for latches 15 and 18. When latch 15 is set, its Q output assumes a high voltage state that is coupled to the clock input terminal of the counter 16 to initiate the counting of the A'–B' frequency transitions. During this same time interval, the latch 18 is "set" and its Q output is set to a high voltage state that is coupled to the one-shot multivibrator 17 to commence the timing of the elapsed time since the A' frequency has been detected. If the subsequent or second A' frequency is not detected before the timer 17 times out at twenty seconds, the multivibrator timer 17 output at pin 7, $\overline{Q}$ returns to a high voltage level state. The high state at $\overline{Q}$ for the timer 17 will couple a reset signal to pin 15 of counter 16 to re-initiate a counting sequence. Similarly, the timer 17 must be re-actuated with the reception of a subsequent A' frequency excursion.

Assuming circuit 12 detects a A' frequency during the 20 second period of the timer 17, the output signal from circuit 12, inverted at inverter 14 will be coupled to the reset (R) terminal of the latch 15 and resetting the Q output of the latch. This will result in one A'–B' frequency transition to be counted. Accordingly, the alternate setting and resetting of latch 15 will count up the counter 16 as long as the subsequent A' frequency occurs during the 20 second time interval of the timer 17 thereby guaranteeing against false alarms. Assuming the second A' frequency transition occurs 18 seconds after the first A' frequency is detected, the timer 17 is reset for an additional 20 seconds to monitor the next transition. The selected count from the counter 16 is coupled by means of a closed, selected switch S2–S5 to the latch 19. The counter output signal sets latch 19 so that its Q output will switch to a high voltage level. The switching of latch 19 will cause the deenergized transistor Q1 to be switched to a conductive state. With the transistor Q1 conductive the alarm devices are all energized from the 12 V battery. The light signal alarm, LED1 is energized, the audible alarm buzzer PE is actuated and relay coil K1 is energized. The energization of relay coil K1 causes at least a single contact arranged in series with one power lead to the vehicle's sound system to be disconnected and thereby deactuating the radio, tape or the like. This occurs when the relay contact is switched to the open position with the energization of coil K1. This should greatly aid the motor vehicle operator to be alerted to the oncoming emergency vehicle with an operative siren. Once the motor vehicle operator is alerted to the oncoming emergency vehicle, he can reset the alarm, by pushing the reset button R.

Figure 5:
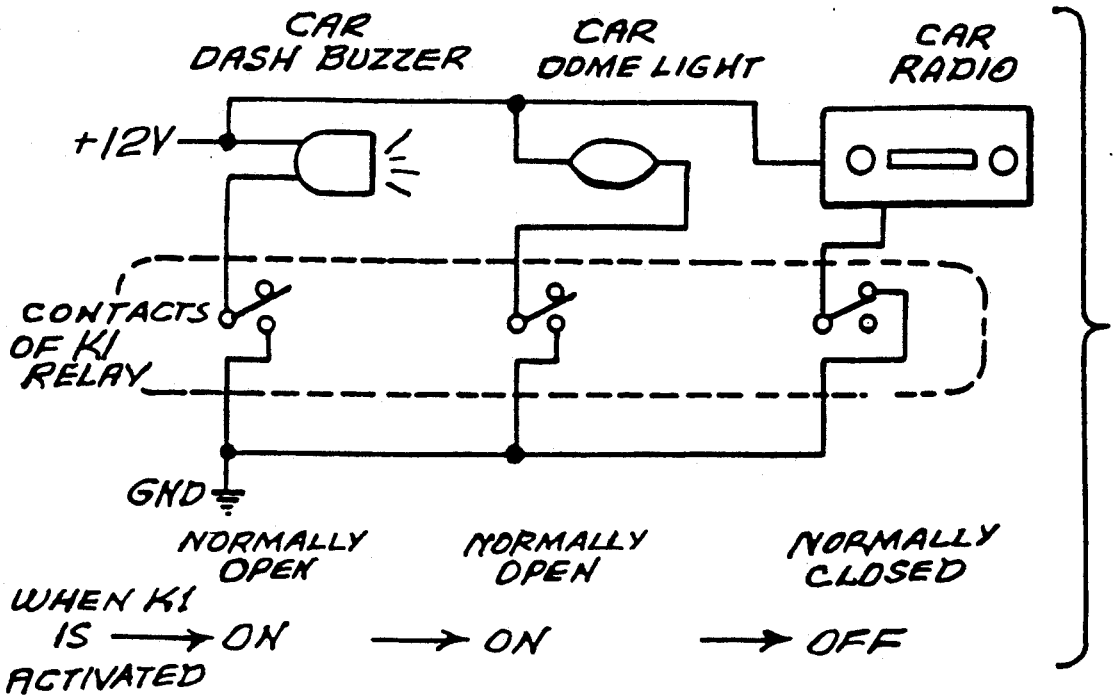
FIG. 5 is a diagrammatic representation of the accessory devices illustrated in FIG. 1 that may be controlled at the time of the production of a warning signal to aid the motor vehicle operator.

FIG. 5 illustrates another embodiment of relay K1 with three contacts for controlling the energization and de-enerization of a buzzer at the vehicle dashboard and the dome light for the vehicle. The relay contacts for these devices are normally open, as illustrated and are closed only when an alarm signal is provided at latch 19. The car radio contact functions as described hereinabove. This then, simultaneously actuates the alarm signal, buzzer and dome light for alerting the motor vehicle operator.

Figure 6:
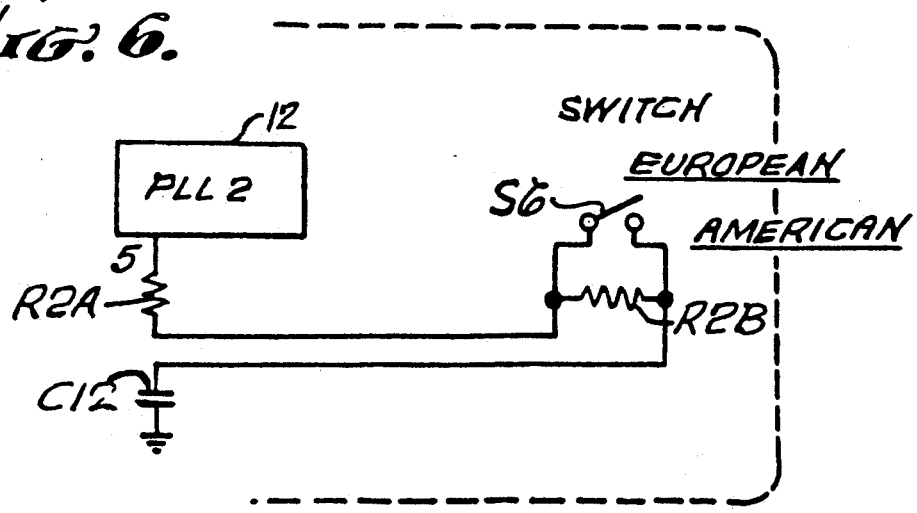
FIG. 6 is a modification of the circuit of FIG. 4 for sensing European type sirens.
Figure 7:
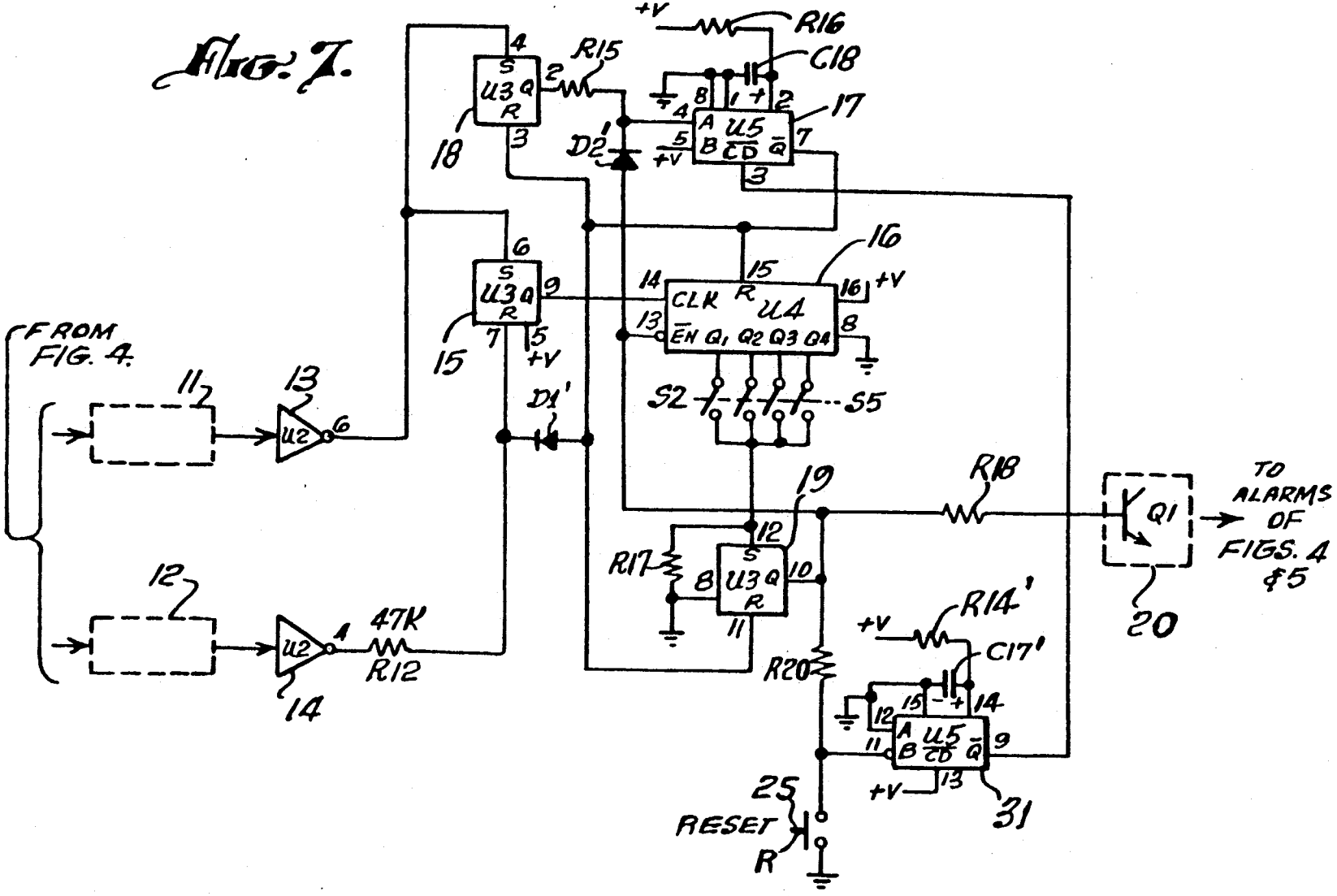
FIG. 7 is a partial, schematic circuit diagram illustrating a circuit modification for automatically and manually resetting the alarm along with a hold off feature.

In FIG. 6, a modification of the circuitry for the sensor SS is illustrated for use with European-type sensors. The frequency range of European sirens is not as high as American sirens and therefore the A'–B' frequencies selected are 1200 cycles and 1100 cycles, respectively. For this purpose, the phase locked loop circuit 11 still detects the A' frequency but the circuit parameters for the circuit 12 must be modified to detect a B' frequency of 1100 cycles. FIG. 6 illustrates the simple manner that this may be accomplished by the provision of a "European" switch S6 that is normlly closed. The switch S6 is connected across the two terminals of resistor 2B. The switch S6 is connected in series circuit relationship with the resistor 2A and capacitor C12, as illustrated in FIG. 4. When the switch S6 is in a closed position, the sensor SS functions as described hereinabove. When the sensor SS is used on a vehicle subjected to a European type siren, the switch S6 is opened and thereby shorting out the resistor 2B. This increase in resistance value modifies the response of the phase locked loop circuit 14 to the new B' frequency. With this modification the sensor SS will operate as decribed for the American sensor. Now referring to FIG. 7, a modification of the circuit of FIG. 4 including an automatic reset circuit and a hold off circuit will now be described. The portion of the siren sensing circuit SS illustrated in FIG. 7 is only that portion for providing the additional functions not illustrated in FIG. 4. For this purpose, the modified circuitry is operative from the output signals from the A' and B' frequency detectors 11 and 12 respectively. The elements bearing the same reference numerals in FIGS. 4 and 7 function as described hereinabove, as well as the portion of the circuit controlled by the alarm switch 20. The principal piece of structure added is the timer 31, a monostable multivibrator which may be the second half of integrated-circuit package for the timer 17 and was not used in the implementation of the circuit of FIG. 4. The resistor R20 is added and the diodes D1 and D2 have been rearranged and appear as diodes D1' and D2' in FIG. 7.

As in FIG. 4, when the alarm is activated, in this modification, the timer 17 will be retriggered by the signal derived from pin 10, Q output, for the latch 19 by means of the diode D2' connected to the input, pin 4, of the timer 17. At the end of the 20 second time interval, the timer 17 resets the entire alarm circuit when the pin 7, $\overline{Q}$ output goes high. This high $\overline{Q}$ output resets the counter 16, latches 15, 18 and 19. The reset signal is coupled to the reset terminal of latch 15, pin 7, by means of diode D1' while it is directly coupled to each of the other circuit elements.

The timer 31 is constructed to provide a hold off period of 1 minute so that the siren sensor SS can not be reactuated, for a period of one minute during which period the vehicle's devices such as the radio are again enabled. When latch 19 is reset at the end of the time period for the timer 17, the low output voltage at pin 10, Q, of latch 19 is coupled through resistor R20 to pin 11, the B input to the timer 31. The A input of timer 31 is coupled to ground potential while pins 14 and 15 are coupled to ground through capacitor C17 and to +V through resistor R14', as illustrated. Pin 13, CD, of timer 19 is connected to +V, while the $\overline{Q}$ output terminal, pin 9, of the timer 31 is connected directly to pin 3, $\overline{CD}$, for timer 17. When the timer 31 has been triggered, its $\overline{Q}$ output goes to a low voltage state for approximately 1 minute. Accordingly, this causes timer 17 to be cleared and holds the $\overline{Q}$ output at pin 7 of the timer 17 at a high voltage state thereby resetting the entire alarm circuit for this 1 minute period. This holds the siren SS in an "off" postion until the timer 31 times out at which time the timer 9, $\overline{Q}$, output goes to a high state and resets timer 17 so that all circuits are reactivated. In the event the described automatic reset circuit is not operative, a manual reset switch 25 is provided for initiating the hold off period. In this embodiment, the reset switch 25 is connected in series circuit with the resistor R20 and ground potential as illustrated for the hold off or inactive period.

It should be noted that when the alarms are activated, the latch 19 has its Q output at a high level state and diode D2' holds pin 4, input A, of the timer 17 at a high state so that the timer 17 can not be retriggered. At the end of the twenty second timing period, the timer causes the $\overline{Q}$, pin 7, output to go to a high state and resets latches 18, 15, 19 and counter 16. When latch 19 is reset, its Q output, pin 10, is set to a low level initiating the 1 minute hold off timing period for the timer 31.

The present invention will detect siren sounds that originate at distances at 800 to 1000 feet of a motor vehicle and actuates an alarm for 20 seconds accompanied with the deenergization of the motor vehicle's sound system. When the automatic reset/hold off feature is implemented, the alarms are deactuated after the 20 second alarm period and can not be re-activated for a hold off period of one minute at which time the sound system is re-energized until the successive siren sound is detected.

It should now be appreciated by those skilled in the art that the siren sensor of the present invention has advanced the state of the art by the provision of a reliable, inexpensive and dependable solid state circuit for detecting siren sounds, without false alarms, to alert a motor vehicle operator of an oncoming emergency vehicle with an operative siren.

We claim:

1. A method of warning a motor vehicle driver of an approaching, distant emergency motor vehicle having a sounding siren, the siren being characterized as emitting loud, audible frequencies that vary with time at a repetitive rate between a "low-A" frequency and a "high-B" frequency for sounding a warning siren sound, the method including the steps of selecting only two predetermined audio frequencies A' and B' that fall within said low A and high B frequency range of a siren to be individually electronically detected and processed, providing a microphone responsive to audio signals including the frequencies between said "low-A" and "high-B" frequency range for converting the audio signals to corresponding electrical signals, amplifying the electrical signals provided by the microphone, filtering the amplified electrical signals for providing electrical signals falling only within said low A and high B frequency range and including said A' and B' frequency signals, detecting and processing the A' and B' frequency transitions for determining a preselected number of the selected A' and B' frequency transitions, and providing a warning signal representative of an approaching emergency motor vehicle having a sounding siren upon determining the preselected number of said A' and B' frequency transitions.

2. A method of warning a motor vehicle driver of an approaching, distant emergency motor vehicle having a sounding siren, the siren being characterized as emitting loud, audible frequencies that vary with time at repetitive rate between a "low-A" frequency and a "high-B" frequency for sounding a warning siren sound, as defined in claim 1 including the step of automatically terminating the warning signal after a preselected time interval.

3. A method of warning a motor vehicle operator as defined in claim 2 including the step of maintaining the warning signal inactive for a preselected time period after the termination of the warning signal.

4. A method of warning a motor vehicle operator as defined in claim 3 wherein the step of maintaining the warning signal inactive is automatically initiated after the termination of the warning signal.

5. A method of warning a motor vehicle drier of an approaching, distant emergency vehicle having a sounding siren, the siren being characterized as emitting loud, audible frequencies that vary with time at a repetitive rate between a "low-A" frequency and a "high-B" frequency for sounding a warning siren sound as defined in claim 1 including the steps of mounting the microphone on the motor vehicle to be responsive to said audio signals, and the warning signal is arranged within the motor vehicle for actuating an audible alarm or a visible alarm or both for warning the motor vehicle driver of the approaching emergency motor vehicle.

6. A method of warning a motor vehicle driver of an approaching, distant emergency motor vehicle having a sounding siren, the siren being characterized as emitting loud, audible frequencies that vary with time at a repetitive rate between a "low-A" frequency and a "high-B" frequency for sounding a warning siren sound, as defined in claim 5 or 2 wherein the motor vehicle has a sound generating system and further comprising the step of de-energizing said sound generating system in response to the provision of the warning signal to aid the motor vehicle driver to hear the approaching, emergency vehicle sounding siren.

7. A method of warning a motor vehicle operator as defined in claim 5 including the step of providing manual means operative for resetting the warning signal once the motor vehicle operator is warned of the emergency motor vehicle.

8. A method of warning a motor vehicle driver of an approaching, distant emergency motor vehicle having a sounding siren, the siren being characterized as emitting loud, audible frequencies that vary with time at a repetitive rate between a "low-A" frequency and a "high-B" frequency for sounding a warning siren sound, the method is characterized as electronically detecting the distant sounding siren sounds including the steps of selecting only two predetermined audio frequencies A' and B' that fall within the low A and high B frequency range of a siren to be individually electronically detected and processed, providing a microphone responsive to audio signals including said low A and high B frequency signals for converting the received audio signals to corresponding electrical signals, filtering the electrical signals from the microphone for providing output signals in said low A and high B siren frequency range of signals including said A' and B' signals and attenuating all other microphone signals, detecting the selected A' frequency signals from the output signals resulting from the filtering step and providing an A' output signal representative of the occurence of the A' frequency signal, detecting the selected B' frequency signals from the output signals resulting from the filtering step and providing a B' output signal representative of the occurence of the B' frequency signal, counting the number of the A' and B' output signals from the detecting steps only if they occur within a pre-selected time interval and producing an output count signal after a preselected number of said A' and B' frequency signals occur representative of a preselected number of A' and B' frequency signal transitions, and actuating a warning device in response to the output count signal.

9. A method of warning a motor vehicle driver of an approaching, distant emergency motor vehicle having a sounding siren, the siren being characterized as emitting loud, audible frequencies that vary with time at a repetitive rate between a "low-A" frequency and a "high-B" frequency for sounding a warning siren sound, as defined in claim 8 including the step of automatically de-actuating the warning device after a preselected time period and automatically disabling the electronic detection of the distant siren sounds for a preselected time interval after actuation of the alarm device.

10. A method of warning a motor vehicle driver of an approaching, distant emergency motor vehicle having a sounding siren, the siren being characterized as emitting loud, audible frequencies that vary with time at a repetitive rate between a "low-A" frequency and a "high-B" frequency for sounding a warning siren sound, as defined in claim 8 or 9 wherein the motor vehicle includes a motor vehicle radio or sound reproducing device or both including the step of de-energizing the motor vehicle radio or any sound reproducing device in response to the output count signal.

11. A method of warning a motor vehicle driver of an approaching, distant emergency motor vehicle having a sounding siren, the siren being characterized as emitting loud, audible frequencies that vary with time at a repetitive rate between a "low-A" frequency and a "high-B" frequency for sounding a warning siren sound, as defined in claim 8 including terminating the actuation of the warning device and manually resetting the electronic detention of the distant siren sounds for initiating a complete new sequence of detection.

12. An apparatus for warning a motor vehicle driver of an approaching, distant emergency motor vehicle having a sounding siren, the siren being characterized as emitting loud, audio frequencies that vary with time at a repetitive rate between a "low-A" frequency and a "high-B" frequency when a warning siren is operative, said apparatus comprising means for sound detecting audio signals including the audio siren sounds for converting the audio signals to corresponding analog electrical signals, amplifying means coupled to said sound detecting means for amplifying the analog electrical signals received from said detecting means, band pass filtering means coupled to be responsive to the analog electrical signals from said amplifying means and defined for transmitting the analog electrical signals having frequencies falling within the "low-A" and "high-B" siren frequencies and attentuating the remaining electrical signals, first circuit means coupled to be responsive to the electrical signals from said filtering means and constructed and defined for detecting only a A′ frequency signal having a preselected frequency above said "low-A" frequency received from said filtering means and providing an output indication representative of the detection of said A′ frequency signal, second circuit means coupled to be responsive to the electrical signals from said filtering means and constructed and defined for detecting only a said B′ frequency signal having a preselected frequency below said "high-B" frequency and different than said A′ frequency received from said filtering means and providing an output indication representative of the detection of said B′ frequency signal, and means coupled to the output indications from said first and second circuit means for determining the number of frequency transitions between the A′ and B′ frequencies and providing an alarm signal after a preselected period representative of a preselected number of said A′ and B′ frequency transitions have been determined.

13. An apparatus for warning a motor vehicle driver of an approaching, distant emergency motor vehicle having a sounding siren, the siren being characterized as emitting loud, audio frequencies that vary with time at a repetitive rate between a "low-A" frequency and a "high-B" frequency as defined in claim 12, including a timing means coupled to be responsive to the output indications from said first circuit means for timing the occurrence of the A′ and B′ frequency transitions for eliminating any electrical signal transitions from said first circuit means that do not occur within a preselected time period measured by said timing means and thereby eliminating any false alarm signals.

14. An apparatus for warning a motor vehicle driver of an approaching, distant emergency motor vehicle having a sounding siren, the siren being characterized as emitting loud, audio frequencies that vary with time at a repetitive rate between a "low-A" frequency and a "high-B" frequency as defined in claim 12 or 13, including means for manually resetting said means for determining the number of said frequency transitions for initiating another determination period.

15. An apparatus for warning a motor vehicle operator of an approaching emergency motor vehicle having an operative siren emitting sounds in a preselected frequency range that vary with time at a preselected rate to enable the motor vehicle operator to take appropriate action, said apparatus comprising microphone means mountable with a motor vehicle for converting audio signals including said siren sound signals to corresponding electrical signals, filtering means coupled to be responsive to the electrical signals from said microphone means for filtering out said siren electrical signals and attentuating the remaining electrical signals, and determining means coupled to be responsive to the electrical siren signals from said filtering means for processing two different preselected frequency signals with the siren signals for determining the occurrence of a preselected number of the two siren signal transitions within a preselected time period to provide a warning signal upon the occurrence of the preselected number of said siren signal transitions.

16. An apparatus for warning a motor vehicle operator of an approaching emergency motor vehicle having an operative siren emitting sounds in a preselected frequency range that vary with time at a preselected rate to enable the motor vehicle operator to take appropriate action as defined in claim 15 including timing means having a preselected timing period coupled to be responsive to the electrical siren signals to be rendered operative in response to each of said two siren signal transitions to time each of the transitions to prevent the provision of a false warning signal when the frequency transitions do not occur within said preselected timing period.

17. An apparatus for warning a motor vehicle operator of an approaching emergency motor vehicle having an operative siren emitting sounds in a preselected frequency band that vary with time at a preselected rate to enable the operator to take appropriate action, said apparatus comprising microphone means mountable with a motor vehicle for converting audio sound signals including said siren sounds and non-siren sounds to corresponding electrical signals, filtering circuit means coupled to be responsive to the electrical signals for filtering out the siren electrical frequency band of signals and attentuating the non-siren electrical signals, first detector means for detecting only a first preselected A′ frequency falling within the frequency signal band of the electrical signals and providing output signals representative of the detected first preselected frequency, second detector means for detecting only a second preselected B' frequency signal falling within the frequency band of the siren electrical frequency band but different from said first preselected frequency and providing output signals representative of the detected second preselected frequency, first electronic binary counting means coupled to be responsive to the output signals from said first and second detector means to count up said counting means in response to each said A', B' frequency transitions occurring during a preselected time period, said first counting means providing output count signals representative of each said A' and B' frequency transition coupled thereto, and means coupled to be responsive to the preselected count signals from said first counting means for providing an alarm signal representative of an approaching operative siren.

18. An apparatus for warning a motor vehicle operator as defined in claim 17 wherein said first and second detector means each comprise a tone decoder or phase locked loop means for providing output signals responsive to said first and second preselected frequencies respectively.

19. An apparatus for warning a motor vehicle operator of an approaching emergency motor vehicle as defined in claim 17 including first electronic timing means coupled to be responsive to the output signals from said first and second detector means for initiating a preselected timing interval related to the time period of each said A' and B' transitions and coupled to said counting means for resetting said first counting means upon the expiration of said preselected timing interval without each said A' and B' frequency transition occurring, and circuit means coupled to be responsive to the output signals from said first and second detector means and coupled to said timing means for resetting said timing means upon the occurrence of each said A' and B' frequency transition during the preselected timing interval for said timing means for reinitiating a new timing interval.

20. An apparatus for warning a motor vehicle operator as defined in claim 19 including second electronic timing means for disabling the apparatus for warning a motor vehicle operator for a preselected time period.

21. An apparatus for warning a motor vehicle operator as defined in claim 20 including manual means for cancelling said alarm signal and resetting said first counting means and said first and second timing means.

22. An apparatus for warning a motor vehicle operator as defined in claim 19 wherein said electronic timing means comprises a retriggerable monostable multivibrator.

23. An apparatus for warning a motor vehicle operator as defined in claim 17 or 19 wherein said alarm signal is coupled to an audible signalling device.

24. An apparatus for warning a motor vehicle operator as defined on claim 17 or 19 wherein said alarm signal is coupled to a visible signalling device.

25. An apparatus for warning a motor vehicle operator as defined in claim 17 or 19 wherein said motor vehicle includes a motor vehicle sound system and a power source therefor, and said alarm signal is adapted to be coupled to the power source of the motor vehicle sound system for de-energizing same in response to said alarm signal.

26. An apparatus for warning a motor vehicle operator as defined in claim 17 including timing means wherein said means coupled to be responsive to the preselected count signal from said first counting means provides a re-triggering signal to said timing means and said electronic binary counting means along with the alarm signal for de-activating the alarm signal after said first counting means counts out.

27. An apparatus for warning a motor vehicle operator, as defined in claim 26 including means for maintaining the first electronic binary counting means inactive for a preselected time interval.

28. An apparatus for warning a motor vehicle operator as defined in claim 27 wherein said means for maintaining the first electronic binary counting means inactive comprises a second electronic binary counting means having a preselected timing period that is coupled to be responsive to the means for providing an alarm signal upon the deactivation of the alarm signal for triggering the second electronic binary counting means for automatically holding the first electronic binary counting means inactive for the time period of the second binary counting means.

29. An apparatus for warning a motor vehicle operator as defined in claim 28 including manually operative switch means operative for triggering the second electronic binary counting means for the counting period of the second binary counting means to disable the alarm signal for the period of said second binary counting means.

* * * * *

UNITED STATES PATENT AND TRADEMARK OFFICE

CERTIFICATE OF CORRECTION

PATENT NO. : 5,278,553

DATED : January 11, 1994

INVENTOR(S) : Robert H. Cornett et al

It is certified that error appears in the above-identified patent and that said Letters Patent is hereby corrected as shown below:

On title page, item [57] Abstract:
add the following;

The step of processing the output indications includes the step of timing the A'-B' frequency transition to prevent producing a false warning signal.

column 16, line 33, after "signals" delete "with" and substitute --within--;

column 17, line 23, after "decoder" and before "or" insert a "slash (/)".

Signed and Sealed this

Fourteenth Day of June, 1994

Bruce Lehman

*Attest:*

BRUCE LEHMAN

*Attesting Officer*

*Commissioner of Patents and Trademarks*